US010900631B2

(12) United States Patent
Garin et al.

(10) Patent No.: US 10,900,631 B2
(45) Date of Patent: Jan. 26, 2021

(54) OPTICAL ELEMENT FOR MOTOR VEHICLE OPTICAL MODULE

(71) Applicant: VALEO VISION, Bobigny (FR)

(72) Inventors: Pascal Garin, Bobigny (FR); Stephane Andre, Bobigny (FR)

(73) Assignee: VALEO VISION, Bobigny (FR)

( * ) Notice: Subject to any disclaimer, the term of this patent is extended or adjusted under 35 U.S.C. 154(b) by 60 days.

(21) Appl. No.: 16/195,235

(22) Filed: Nov. 19, 2018

(65) Prior Publication Data

US 2019/0154221 A1 May 23, 2019

(30) Foreign Application Priority Data

Nov. 20, 2017 (FR) ..... 17 60932

(51) Int. Cl.
*F21S 41/24* (2018.01)
*F21S 45/47* (2018.01)
(Continued)

(52) U.S. Cl.
CPC ..... *F21S 41/24* (2018.01); *F21S 41/143* (2018.01); *F21S 41/25* (2018.01); *F21S 41/255* (2018.01);
(Continued)

(58) Field of Classification Search
CPC .. F21S 41/24; F21S 41/25; F21S 41/47; F21S 41/143; F21S 41/255; F21S 41/29;
(Continued)

(56) References Cited

U.S. PATENT DOCUMENTS 5,730,519 A * 3/1998 Okuchi ..... F21S 41/24 362/559
2010/0226142 A1* 9/2010 Brendle ..... F21S 41/683 362/512

(Continued)

FOREIGN PATENT DOCUMENTS

WO WO 2012/059852 A1 5/2012
WO WO-2012059852 A1 * 5/2012 ..... F21S 43/14
WO WO 2017/168387 A1 10/2017
WO WO-2017168387 A1 * 10/2017 ..... F21S 43/239

OTHER PUBLICATIONS

French Preliminary Search Report dated Feb. 16, 2018 in French Application 17 60932 filed on Nov. 20, 2017 (with English Translation of Categories of Cited Documents).

*Primary Examiner* — Mary Ellen Bowman
(74) *Attorney, Agent, or Firm* — Oblon, McClelland, Maier & Neustadt, L.L.P.

(57) ABSTRACT

A monobloc optical element including a first end including a plurality of light inlets distinct from one another via which rays of light enter the optical element, the optical element including a second end via which the rays of light exit together, the second end being configured to shape a beam of light external to the optical element, the optical element being defined by an axis passing at least through the first end and through the second end, characterized in that the optical element includes at least a first contact zone dedicated to referencing it mechanically along the axis and at least a second contact zone dedicated to referencing it mechanically in a direction transverse to the axis, the second contact zone being closer to the second end than to the first end.

19 Claims, 2 Drawing Sheets

(51) Int. Cl.

| | |
|---|---|
| ***F21S 41/50*** | (2018.01) |
| ***F21S 41/29*** | (2018.01) |
| ***F21S 41/255*** | (2018.01) |
| ***F21V 17/10*** | (2006.01) |
| ***F21S 41/47*** | (2018.01) |
| ***F21V 17/00*** | (2006.01) |
| ***F21S 41/143*** | (2018.01) |
| ***F21S 41/43*** | (2018.01) |
| ***F21V 29/503*** | (2015.01) |
| ***F21S 41/25*** | (2018.01) |

(52) U.S. Cl.
CPC ..... *F21S 41/29* (2018.01); *F21S 41/43* (2018.01); *F21S 41/47* (2018.01); *F21S 41/50* (2018.01); *F21S 45/47* (2018.01); *F21V 17/005* (2013.01); *F21V 17/104* (2013.01); *F21V 29/503* (2015.01)

(58) Field of Classification Search
CPC . F21S 41/43; F21S 41/50; F21S 45/47; F21V 29/503; F21V 17/005; F21V 17/104
See application file for complete search history.

(56) References Cited

U.S. PATENT DOCUMENTS

| | | | | |
|---|---|---|---|---|
| 2012/0275173 | A1* | 11/2012 | Hamm | F21S 41/24 362/487 |
| 2015/0124469 | A1* | 5/2015 | Krenn | F21S 41/43 362/511 |
| 2016/0169467 | A1* | 6/2016 | Fedosik | F21S 41/147 362/511 |
| 2017/0030542 | A1* | 2/2017 | Gromfeld | F21S 41/24 |
| 2018/0370419 | A1* | 12/2018 | Danner | F21S 41/29 |
| 2019/0086050 | A1* | 3/2019 | Dikau | F21S 41/143 |

* cited by examiner

OPTICAL ELEMENT FOR MOTOR VEHICLE OPTICAL MODULE

The present invention relates to the field of optical modules used for the lighting and/or signalling in motor vehicles, and applies more particularly to optical modules comprising optical devices for forming various light beams, notably intended to form lights referred to as "low beam" and lights referred to as "high beam".

Motor vehicle headlamps are usually made up of a housing which is closed by a transparent wall through which one or more beams of light pass. This housing houses at least one optical device, chiefly comprising a light source and an optical element configured to shape the light generated by the light source in order to offer specific vehicle lighting and/or signalling services. For example, the optical element may be configured to allow a beam of light referred to as low beam to be projected out from the headlamp so as notably to limit the dazzling of the drivers of oncoming vehicles.

In order to perform this low beam headlamp function, the optical device comprises at least one light source, an optical element positioned facing the light source to guide the rays of light, a shielding element configured to form a cutoff for the rays of light emitted so as to form a partial light beam capable of not dazzling third parties as it leaves the headlamp, and a lens for shaping these rays of light in order to form the light beam that leaves the headlamp. It will be appreciated that the shielding element is placed in the path of the rays of light, some distance from the light source, and that its long term position needs to be assured in order for the shape imparted to the rays of light for the light beam referred to as low beam to remain stable over time.

Furthermore, additional optical devices may be associated in the one same headlamp in order to perform a high beam function, capable of illuminating a road scene out to a long range, when the risk of dazzling third parties is not present. These additional optical devices further comprise one or more light sources and an optical element associated with a shaping lens for projecting the rays of light.

For the sake of compactness, optical modules are provided in which these two functions are performed, it being necessary for the light sources and the optical elements to be arranged relative to one another in such a way as to achieve these various functions according to whether one, the other, or both of the light sources is switched on. First light sources are switched on when a first light beam of the low beam type is to be emitted, and second light sources are switched on in addition in order to emit an additional beam of light to this first beam of light so that by combining the two beams of light a light beam of the high beam type is formed.

In such optical modules, the shielding element that makes it possible to create the cutoff for the first light beam may for example be incorporated into the optical element of the additional optical device(s).

A first disadvantage with such a module lies in how complicated it is to control dimensional manufacturing spread. Specifically the cutoff of the first beam is influenced by the way in which the shield is attached, by its manufacturing tolerances and by the manufacturing tolerances on the component which supports this shielding element.

It has also become apparent that mechanical vibrations and the variations in temperature to which the optical module is exposed during its use may over time lead to a variation in the more or less pronounced inclination of the optical elements with respect to the light sources. This inclination has the disadvantage of modifying the zone illuminated by the low beam, and this may prove disagreeable or dangerous, particularly to drivers of oncoming vehicles. It is therefore necessary to perform regular maintenance on the optical module in order to correct this defect and prevent any accident.

The invention proposes to create an optical module in which the position and attachment of the optical element of the additional optical device take account of the manufacturing tolerances, while at the same time being less liable to vary over the course of time or with temperature with respect to the light source(s) associated therewith.

One subject of the present invention is therefore a monobloc optical element comprising a first end comprising a plurality of light inlets distinct from one another via which rays of light enter the optical element, the optical element comprising a second end via which the rays of light exit together, the second end being configured to shape a beam of light external to the optical element, the optical element being defined by an axis passing at least through the first end and through the second end. According to the invention, the optical element comprises at least a first contact zone dedicated to referencing it mechanically along the axis and at least a second contact zone dedicated to referencing it mechanically in a direction transverse to the axis, the second contact zone being closer to the second end than to the first end.

It will be appreciated that the first end of the optical element forms an inlet face via which the rays of light enter the optical element and that the second end forms an exit face via which these rays exit. In the remainder of the document, the terms "first end of the optical element" and "inlet end of the optical element" may be used interchangeably, as may the terms "second end of the optical element" and "exit face of the optical element", these pairs of terms referring to the one same object. The first end of the optical element comprises several distinct light inlets, which means to say inlets separated from one another, by a recess formed in the optical element. The second end of the optical element comprises a single light exit, which means to say a single zone through which rays coming from at least two light inlets that make up the first end pass.

The second end is configured to shape a beam of light external to the optical element, which means to say a light beam distinct from the one that passes through the optical element. Such an external beam passes over or under the optical element. The shaping of this external light beam is obtained when the second end, notably a peripheral sharp edge of this second end, influences the shape of the external light beam, for example via a rectilinear or substantially rectilinear cutoff.

What is understood by "monobloc" is that the optical element forms a single assembly that cannot be dismantled without causing damage to at least one of the elements of which it is made. In other words, the inlet face formed by the first end of the optical element cannot be separated from the exit face of this optical element, this exit face being formed by the second end of this optical element, without one of these faces becoming damaged.

As mentioned hereinabove, the inlet face of the optical element comprises a plurality of distinct light inlets, which means to say that each of these light inlets is associated with at least one single light source.

According to one feature of the present invention, a first plane passing through the first contact zone and a second plane passing through the second contact zone form an angle comprised between 45° and 90°.

According to one aspect of the present invention, the optical element comprises a sharp edge situated at an intersection between the second end and a face of the optical element, this sharp edge being configured to cut the external beam of light. This external light beam thus has a cutoff zone, which means to say that only part of the rays of light arriving at this sharp edge will be shaped to form the external light beam.

The optical element according to the invention is intended to be incorporated into an optical module comprising, amongst other things, at least one other optical element, each of these optical elements being configured to shape rays of light emitted by different light sources. What is meant by an "external light beam" is a beam of light shaped by this other optical element.

It will be appreciated from the foregoing that the first contact zone of the optical element allows control over a distance separating the light sources from the first end of the optical element. In other words, this first contact zone allows control over a distance separating the light sources from the light inlets associated with them.

The second contact zone for its part allows control over the position of the sharp edge of the optical element which edge is configured to cut off the external light beam. In other words, this second contact zone allows control over the position of a cutoff zone of this external light beam, which then determines which rays of light do or do not contribute to this external light beam.

According to one exemplary embodiment of the present invention, the first contact zone is closer to the first end of the optical element than to the second end thereof.

In other words, this first contact zone is closer to the inlet face of the optical element than to the exit face of this optical element.

According to one feature of the present invention, at least one arm is arranged on at least one side of the optical element, the arm being configured to support the optical element, the arm comprising the first contact zone and the second contact zone.

Advantageously, this arm forms part of the optical element, which means to say that this arm forms part of the monobloc assembly formed by the optical element. In other words, this arm, and a body of the optical element to which the arm is attached, cannot be separated without causing damage to the arm or to the body of the optical element. It will be appreciated that this body of the optical element comprises the first end of this optical element and the second end thereof.

According to the exemplary embodiment of the present invention, the first contact zone and the second contact zone are formed respectively at a first longitudinal end and at a second longitudinal end of the arm of the optical element. What is meant by a "longitudinal end" is an end of this arm along a main axis of extension thereof.

According to one aspect of the present invention, two arms may be arranged respectively on a first lateral face and on a second lateral face of the optical element, this first lateral face and this second lateral face being opposite with respect to the body of the optical element. According to this aspect of the invention, the two arms each comprise a first contact zone and a second contact zone. In other words, each arm therefore comprises a first contact zone and a second contact zone respectively dedicated to the mechanical referencing of the optical element along the axis and in a direction transverse to this axis.

The invention also relates to an optical module comprising at least a first light source dedicated to forming a first light beam referred to as "low beam", and at least a second light source dedicated to forming a second light beam referred to as "high beam", the first light source and the second light source being supported by a base, the optical module comprising at least a first optical element dedicated to forming the first light beam and a second optical element dedicated to forming the second light beam, the optical module comprising a projection lens for projecting the first light beam and the second light beam, the projection lens and the base being secured to a support and the second optical element being produced according to one of the exemplary embodiments mentioned hereinabove.

According to one feature of the present invention, the base comprises at least one heat sink dedicated to cooling the light sources. The base and the heat sink form an individual unit referred to as the light source cooler.

Advantageously, this base supporting the first light source and the second light source may also comprise an electronic board to which the light sources are connected.

According to the invention, the light sources may be secured directly to the heat sink. Optionally, these light sources may be secured to the electronic board, which is itself secured to the heat sink.

According to one feature of the present invention, a portion of the heat sink forms an end stop against which the first contact zone of the second optical element comes to bear.

It will therefore be appreciated that the first contact zone allows control over the distance separating the light sources from the second optical element, and more particularly the distance separating this second optical element from the light sources associated with it. Thus, the present invention makes it possible to guarantee an ideal distance that allows a maximum amount of light flux to be collected, without the risk of burning the inlet face of the second optical element.

Optionally, that portion of the heat sink that forms an end stop for the first contact zone of the second optical element may comprise a cutout configured to accept a peg emerging from this first contact zone.

Advantageously, this peg may extend in a direction parallel or substantially parallel to the axis of this second optical element.

It will be appreciated that when the first contact zone is arranged on an arm of the second optical element, the peg emerges from the longitudinal end of this arm on which the first contact zone is formed.

According to the invention the support on which the base and the projection lens are secured comprises a first wall chiefly contained inside a third plane and to which the heat sink is at least secured, and a second wall chiefly contained within a fourth plane perpendicular or substantially perpendicular to the third plane, this second wall comprising at least an inclined portion, this inclined portion having a tooth against which the second contact zone of the second optical element bears.

The optical element according to the invention, in this instance the second optical element of the optical module, may comprise at least one arm. According to the invention, at least one stud may emerge from the second wall of the support and extend in a direction parallel to the first wall of this support, the at least one arm of the second optical element being configured to rest on one end of this stud. Advantageously, this stud may be formed as one material with the second wall of the support, which means to say that this stud and the second wall of the support form a single assembly that cannot be separated without causing damage to one or the other.

According to the invention, the support wall may have a bottom and a cover, it being possible for the cover to comprise at least one member bearing against the second optical element.

This member bearing against the second optical element contributes, with the second contact zone, to the mechanical referencing of this second optical element in the direction transverse to the axis.

The second optical element further comprises a sharp edge situated at the intersection between the second end and a face of this second optical element which faces towards the cover of the support, this sharp edge being configured to intersect the first light beam.

It will be appreciated that the member bearing against the second optical element thus contributes to stabilizing the position of this sharp edge and therefore to stabilizing the cutoff zone of the first light beam.

Optionally, at least one of the arms of the second optical element comprises a chamfer against which the member can come to bear.

Further features, details and advantages will become more clearly apparent from reading the detailed description given hereinafter by way of indication with reference to the various embodiments illustrated in the following figures.

Figure 1:
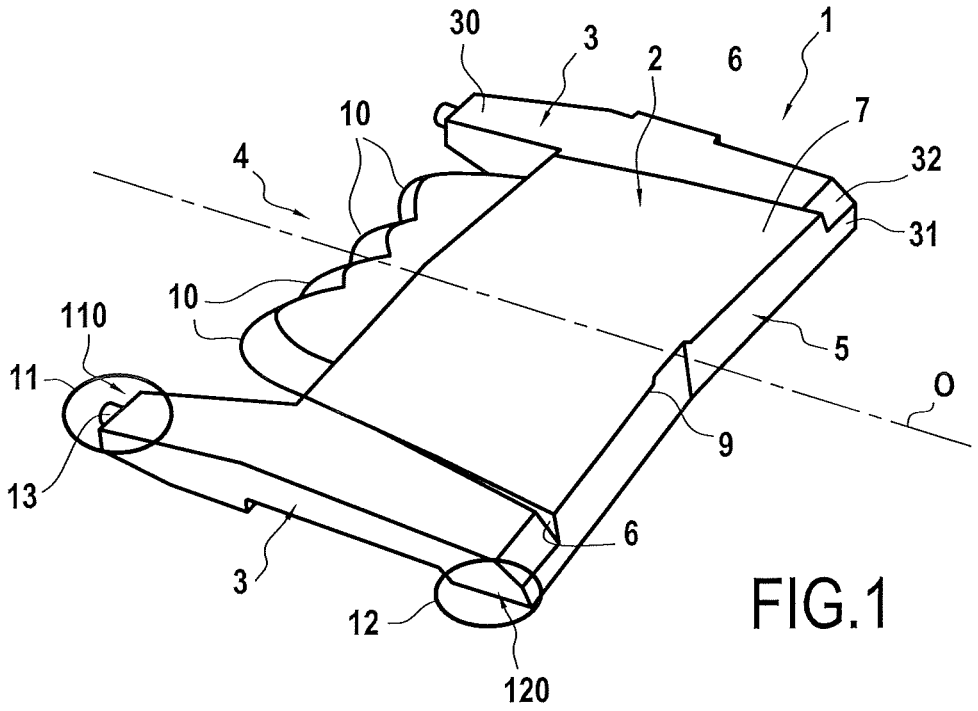
FIG. 1 is a perspective view of an optical element according to one exemplary embodiment of the present invention.

FIG. 1 is a perspective view of an optical element 1 comprising a body 2 and two arms 3, which are on opposite sides of the body 2 to one another. Advantageously, this optical element 1 forms a monobloc assembly which means to say that the body 2 and the arms 3 form a single assembly which cannot be dismantled without one of the arms 3 or the body 2 becoming damaged. As will be described hereinafter, this optical element 1 is intended to be incorporated into an optical module, itself intended to be incorporated into a vehicle, for example a motor vehicle.

The body 2 of this optical element 1 is delimited by a first end 4, by a second end 5, by two lateral faces 6, an upper face 7 and a lower face—not visible in FIG. 1. It should be noted that the terms "upper", "lower" and "lateral" refer to an orientation of the optical element 1 in FIG. 1 and in an example of an application in a given optical module, but that these designations do not imply a limit on the orientation that this optical element 1 may adopt.

As illustrated in this FIG. 1, each of the arms 3 of the optical element 1 is supported by one of the lateral faces 6 of the body 2 of the optical element 1. Each of these arms 3 comprises a first longitudinal end 30 arranged on the side of the first end 4 of the optical element 1, and a second longitudinal end 31, arranged near the second end 5 of the this optical element 1.

The second longitudinal end 31 of each of these arms has a chamfer 32 the purpose of which will be described in greater detail hereinafter. In order to make the figures easier to understand, the references describing the arms 3 of the optical element 1 are borne by just one or other of these arms 3, but it must be understood that they can be transposed from the one to the other.

The optical element 1 also comprises a sharp edge 9 delimiting the second end 5 of this optical element, at its boundary with the upper face 7 of the optical element. As will be described in greater detail hereinafter, this sharp edge 9 is configured to form a cutoff zone for an external beam of light, namely a beam of light that does not come from this optical element 1.

This optical element 1 is configured to shape the rays of light. Thus, the first end 4 forms an inlet face for these rays of light whereas the second end 5 forms an exit face therefor. As can be seen in FIG. 1, the first end 4 comprises a plurality of light inlets 10 distinct from one another. Thus, at least one light source is associated with each of these light inlets 10. By contrast, each light source is associated with just one single light inlet 10.

The rays of light that have entered the optical element 1 by its first end 4 travel through this optical element 1 as far as its second end 5 which is configured to allow these rays of light to exit in the form of a light beam. It will be appreciated that the majority of the rays of light that enter the optical element 1 re-emerge from this single exit face, making the latter an exit common to all these rays of light. This exit face is configured to orient the rays of light which exit the second end 5 in a direction close to a horizontal, or substantially horizontal, plane in which an optical axis of the optical module intended to receive the optical element 1 according to the invention is contained. It will be noted that it is possible for some of the rays of light to not be collimated by the first end 4, this minority of light rays then exiting via other faces of the optical element 1.

The optical element 1 is notably characterized by an axis O which, according to an example illustrated in FIG. 1, passes through a centre of the first end 4 and through a centre of the second end 5. This axis O illustrates an overall direction followed by the majority of the rays of light which passes through the optical element 1. This axis O forms, with the horizontal plane that passes through the optical module, an angle comprised between 10° and 15°.

In order to ensure optimal operation of this optical element 1, its position on the one hand with respect to the light sources and on the other hand according to the cutoff that is to be created on the external beam of light using the abovedescribed sharp edge 9 needs to be ensured.

To this end, the optical element comprises at least one first contact zone 11 dedicated to referencing it mechanically along the axis O, and at least one second contact zone 12 dedicated to referencing it mechanically in a direction transverse to this axis O.

The first contact zone 11 thus allows control over a distance between the light sources and the light inlets 10 associated therewith, while the second contact zone 12 allows control over the position of the sharp edge 9 with respect to the external beam of light. In other words, the second contact zone 12 makes it possible to stabilize the cutoff zone of this external beam of light.

In order to take account of manufacturing tolerances on the components involved and in order to ensure a guaranteed and time-stable position of the sharp edge 9, the second contact zone 12 is advantageously formed closer to the second end 5 than to the first end 4 of the optical element 1. FIG. 1 illustrates one exemplary embodiment of the optical element 1 in which the second contact zone 12 is therefore formed near the second end 5 and in which the first contact zone 11 is itself formed closer to the first end 4 than to the second end 5.

According to the example illustrated in this FIG. 1, the optical element 1 comprises two first contact zones 11 and two second contact zones 12. These first contact zones 11 and these second contact zones 12 are borne by each of the arms 3 of the optical element 1. Thus, each arm 3 comprises a first contact zone 11 and a second contact zone 12 respectively created at the first longitudinal end 30 and at the second longitudinal end 31 of this arm 3. As mentioned previously, the first longitudinal end 30 of the arm corresponds to the longitudinal end of this arm 3 closest to the first end 4 of the optical element 1, and the second longitudinal end 31 of this arm 3 corresponds to its longitudinal end closest to the second end 5 of the optical element 1.

Figure 2:
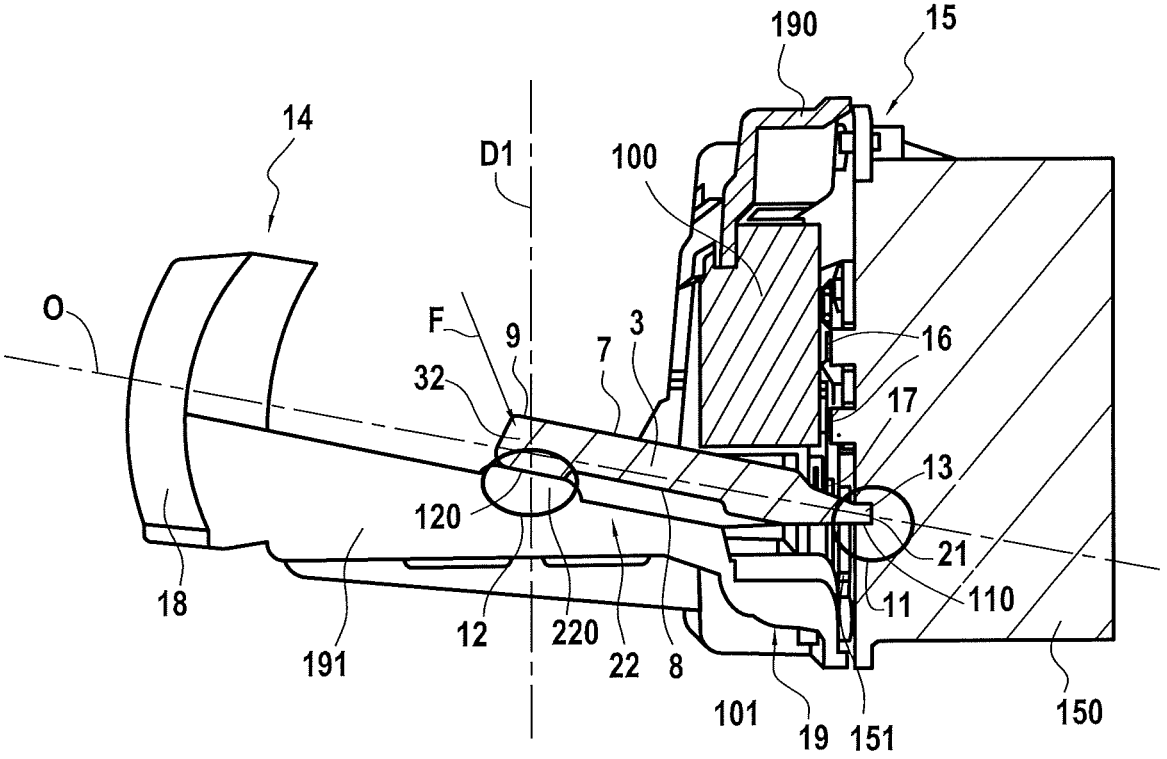
FIG. 2 is a perspective view of a cross section taken on a longitudinal and vertical plane of an optical module comprising at least one optical element according to the exemplary embodiment illustrated in FIG. 1.
Figure 3:
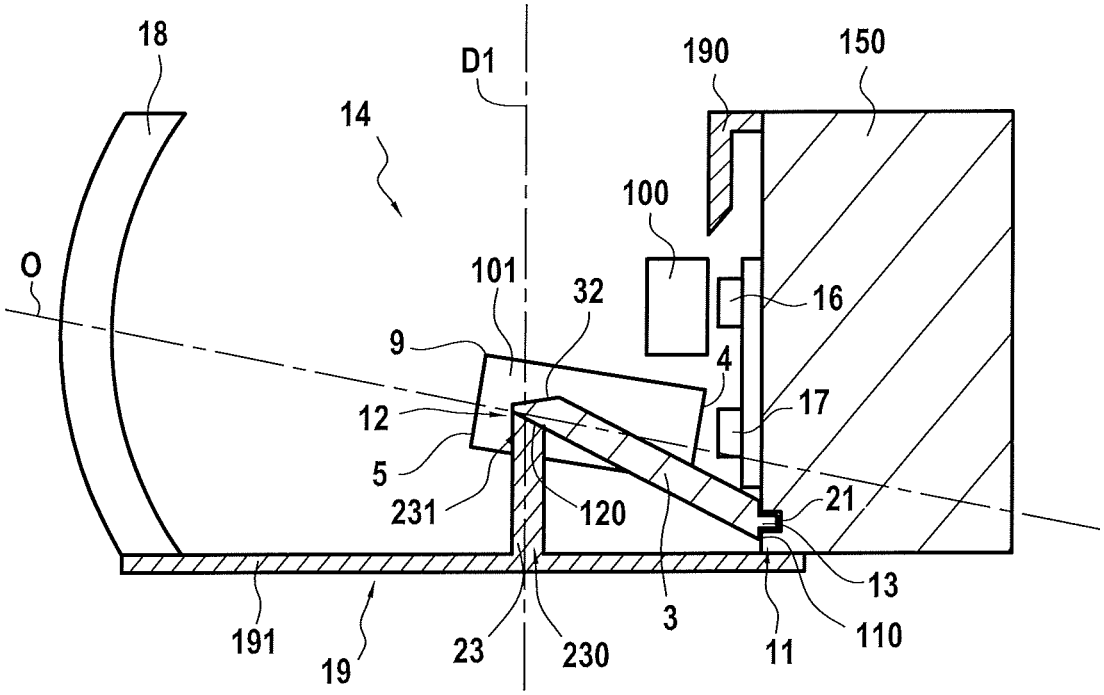
FIG. 3 is a schematic depiction of a cross section, taken on the longitudinal and vertical plane, of an optical module comprising at least one optical element according to one exemplary embodiment of the present invention.

The first contact zone 11 has a flat surface 110, best visible in FIGS. 2 to 4, intended to come into abutment against an element of the optical module into which the optical element 1 is intended to be incorporated. According to the exemplary embodiment illustrated in FIG. 1, a peg 13 emerges from this flat surface 110, this peg 13 being intended to be housed in a cutout formed in the element of the optical module forming an end stop to this first contact zone 11. This element of the optical module and the collaboration between this element and the first contact zone 11 will be detailed more fully hereinafter, notably with reference to FIGS. 2 and 3.

The second contact zone 12 also has a flat surface 120, notably visible in FIGS. 2 to 4. According to the invention, a first plane passing through the first contact zone 11 and a second plane passing through the second contact zone 12 form an angle comprised between 45° and 90°. More exactly, the first plane is a plane containing the flat surface no of the first contact zone 11 and the second plane is a plane containing the flat surface 120 of the second contact zone 12. As will be detailed more fully hereinafter, this angle formed between the first plane and the second plane ensures inclination of the optical element 1 when this is incorporated into the optical module.

Advantageously, the first contact zones 11 borne by the arms 3 of the optical element 1 may be contained within the one same first plane and the two second contact zones 12 borne by this optical element 1 may themselves be contained within the one same second plane.

These first and second contact zones 11, 12, as well as an optical module into which the optical element 1 is incorporated, will now be described in greater detail with reference to FIGS. 2 to 4. FIGS. 2 and 3 illustrate two alternative forms of one exemplary embodiment of the present invention.

FIG. 2 is a perspective view of a section through an optical module 14, this section being taken on a longitudinal and vertical plane, which means to say a plane containing the axis O of the optical element according to the invention and passing both through the upper face 7 of this optical element and through the lower face 8 thereof.

This optical module 14 comprises a base 15 to which at least a first light source 16 and a second light source 17, and advantageously a plurality of first and of second light sources, are secured.

The first light sources 16 are associated with a first optical element 100—depicted schematically—and the second light sources 17 with a second optical element 101. What is meant by "associated" is that each light source 16, 17 emits at least one ray of light intended to pass through the relevant optical element 100, 101. In other words, the first light sources 16 are each able to emit at least one first ray of light intended to pass through the first optical element 100 and the second light sources 17 are each able to emit at least one second ray of light intended to pass through the second optical element 101.

As described hereinabove, these optical elements 100, 101 are configured to shape these rays of light so as to each form a light beam. Thus, the first rays of light emitted by the first light sources 16 are shaped by the first optical element 100 to form a first light beam referred to as "low beam" and the second rays of light emitted by the second light sources 17 are shaped by the second optical element 101 to form a second light beam referred to as "high beam".

In practice, the second light beam is a light beam that complements the first light beam and it is the combination of this first light beam and of this complementary light beam that forms the high beam.

This first light beam and this second light beam finally pass through a projection lens 18 via which they exit the optical module 14. As notably visible in FIG. 2, this projection lens 18 is secured to a support 19 to which is also secured the base 15 that supports the first and second light sources 16, 17. Thus, the support 19 comprises a first wall 190 bearing the base 15 and extending mainly in a third plane and a second wall 191 which extends mainly in a fourth plane perpendicular to the third plane.

The base 15 may be fixed to the first wall 190 of the support 19 by any known means, advantageously by reversible fastening.

The base 15 comprises a heat sink 150 dedicated to cooling the light sources 16, 17, and an electronic board 151 to which the light sources 16, 17 are electrically connected. The use of reversible fastening means for attaching this heat sink 150 to the support 19 make it easier for such a heat sink 150 to be serviced and/or replaced.

According to the example illustrated in FIG. 2, the light sources 16, 17 are secured to the heat sink 150. According to another exemplary embodiment not illustrated here, these light sources may be secured to the electronic board to which they are connected.

As illustrated in FIG. 2, the first wall 190 of the support 19 forms a frame surrounding the electronic board 151 and the first and second light sources 16, 17. In other words, this first wall 190 comprises a cavity for the securing of the light sources 16, 17 and of the electronic board 151 onto the heat sink 150.

When a driver of the vehicle on which the optical module 14 is mounted wishes to switch on his low beam lights, the first light sources 16 are switched on. As mentioned previously, these emit the first rays of light which are shaped by the first optical element 100. In a motor vehicle, low beam is intended to be used when there are other road users present. In order not to dazzle them, the first light beam that forms the low beam must illuminate only a lower portion of the field of view of the driver. As mentioned above, a sharp edge 9 of the second optical element 101 for this purpose creates the cutoff zone for this first light beam by stopping some of the first rays of light shaped by the first optical element 100.

The "truncated" first light beam then passes through the projection lens 18 which makes it possible to invert the image of this first light beam before projecting it onto the road.

It will therefore be appreciated that, according to the example illustrated in FIG. 2, the second optical element 101 is produced according to the invention, which means to say that it is this second optical element 101 which comprises the first and second contact zones 11, 12 described above and which amongst other things make it possible to stabilize the position of the sharp edge 9 of this second optical element 101, and, therefore, control the position of the cutoff zone of the first light beam.

When the driver of the vehicle on which the optical module 14 is mounted wishes to switch on his high beam lights, when the road ahead of the vehicle is largely clear, for example, the first light sources 16 and the second light sources 17 are switched on. The first light sources 16 then form the first light beam described above.

The second light sources 17 for their part emit the second rays of light intended to pass through the second optical element 101. Initially, these second rays of light enter the second optical element 101 via the light inlets formed at the first end thereof. This second optical element 101 shapes these second rays of light which then re-emerge from the second optical element 101 via the second end thereof in the form of the second light beam described above. The first light beam and the second light beam then pass, together, through the projection lens 18 which inverts the image of these light beams in order to form the high beam.

As described hereinabove, it is important for correct operation of the optical module 14, and therefore for the safety of the users of the vehicle and that of third parties sharing the road with this vehicle, that the position of the second optical element 101 be controlled both with respect to the second light sources 17 and with respect to the position of its sharp edge 9 that makes it possible to create the cutoff zone for the first light beam.

To this end, the second optical element 101 comprises the first contact zone 11 and the second contact zone 12. In the example illustrated in FIG. 2 this first contact zone 11 and this second contact zone 12 are thus formed on at least one of the arms 3 of this second optical element 101.

As illustrated in FIG. 2, the first contact zone 11 and, more particularly, the flat surface 110 of this first contact zone 11, comes into abutment against a portion of the base 15 and, more exactly, against a portion of the heat sink 150 that forms part of this base 15. In other words, this portion of the heat sink 150 is contained within a plane parallel to the first plane containing the flat surface no of this first contact zone 11.

Advantageously, that portion of the heat sink 150 that forms an end stop for the first contact zone 11 comprises a cutout 21 able to accept the peg 13 emerging from the flat surface 110 of this first contact zone 11.

Thus, this peg 13 has dimensions that complement the dimensions of the cutout 21.

Because the second light sources 17 are secured to the heat sink 150, it will be appreciated that this first contact zone 11 allows precise control over the distance separating these second light sources 17 from the inlet face of the second optical element 101. This distance can thus be calculated in such a way that the inlet face of the second optical element 101 can collect a maximum amount of second rays of light without the risk of burning this inlet face.

The second wall 191 of the support 19, according to the alternative form of embodiment illustrated in FIG. 2, has an inclined portion 22 on which there is formed a tooth 220 forming an end stop for the second contact zone 12, and more particularly for the flat surface 120 of this second contact zone 12.

Thus, the position of the second optical element 101 is in part governed by a height of the tooth 220 formed on this inclined portion 22, this height being measured in the direction D1 transverse to the axis O of this second optical element 101. According to the example illustrated, this direction D1 is a vertical direction, parallel to the fourth plane containing the first wall 190 of the support 19, and perpendicular to the third plane containing the second wall 191 of this support 19.

Advantageously, this second contact zone 12 therefore allows control over the position of the second optical element 101 in this direction D1 transverse to the axis O and therefore allows control over the position of the sharp edge 9 of this second optical element 101.

As mentioned previously, the first plane passing through the flat surface 110 of the first contact zone 11 forms an angle comprised between 45° and 90° with the second plane containing the flat surface 120 of the second contact zone 12. It will be appreciated from the foregoing that the chosen angle between this first plane and this second plane at least partially determines the position of the second optical element 101 and, more particularly, its inclination with respect to the first light beam. Thus, the position of the cutoff zone of the first light beam can be modified by varying this angle and/or the height of the tooth 220 formed on the inclined portion 22 and forming an end stop for the second contact zone 12.

Because FIG. 2 is a view in cross section, it shows only one arm 3 of the second optical element 101 but it will be appreciated that the first and second contact zones 11, 12 borne by the other arm—not visible in this figure—collaborate with another inclined portion of the second wall 191 of the support 19 and with another portion of the heat sink 150.

According to the invention, the support 190 may comprise a bottom and a cover, this bottom and this cover at least in part closing the optical module 14. The bottom then comprises the first wall 190 and the second wall 191 of the support 19 and the cover—not depicted here in order to leave the various elements of the optical module visible—closes the optical module 14.

Advantageously, this cover may comprise a member which comes to bear against the second optical element 101 in order to stabilize same. For example, this member may come to bear against the chamfer 32 of one of the arms 3 of the second optical element 101. As illustrated in FIG. 2, this bearing member is then configured to apply a force F transverse both to the axis O and to the abovedescribed direction D1 transverse to this axis O.

More advantageously still, the cover may comprise two of these members, each one intended to come to bear against the chamfer 32 of one of the arms 3 of the second optical element 101.

By virtue of this/these member(s), the position of the second optical element 101 is secure both in space and in time because it would be appreciated that the contact zones coupled with this/these member(s) are then only slightly sensitive to the vibrations and other uncontrolled movements that the optical module 14 may experience during use.

FIG. 3 is a schematic depiction of the optical module 14, viewed in a cross section to be taken along the longitudinal and vertical plane, identical to the plane of section of FIG. 2. This optical module 14 differs from the optical module 14 depicted in FIG. 2 notably in the collaboration between the second contact zone 12 of the second optical element 101 and the support 19.

According to this alternative form of embodiment, a stud 23 emerges from the second wall 191 of the support 19 and extends in a direction parallel to the third plane containing the first wall 190 of the support 19. Advantageously, this stud 23 may be of the one same material with the second wall 191 of the support 19, which means to say that this support 19 and this stud 23 form a single assembly that cannot be separated without causing damage to the stud 23 or to the support 19.

This stud 23 thus comprises a first end 230 in common with the support 19 and a free second end 231 acting as an end stop for the flat surface 120 of the second contact zone 12 formed on the arm 3 of the second optical element 101. As depicted in this FIG. 3, this second end 231 is inclined with respect to the horizontal plane of the optical module 14 so as to receive this flat surface 120 of the second contact zone 12.

The first contact zone 11 is itself identical to the first contact zone illustrated in FIG. 2, which means to say that it comprises the flat surface 110 from which there emerges the peg 13 received in the cutout 21 formed in the portion of the heat sink 150 that forms an end stop for this first contact zone 11.

As before, the first contact zone 11 thus allows mechanical referencing of the second optical element 101 along its axis O and the second contact zone 12 itself allows mechanical referencing of the second optical element 101 in the direction D1 transverse to this axis O, this second contact zone 12 being closer to the second end 5 than to the first end 4 of the optical element 101.

Once again, the support 19 may comprise a cover—not illustrated—bearing one or more member(s) intended to come to bear against the second optical element 101, for example against the chamfer(s) 32 of the arm(s) 3 of this second optical element 101, so as to secure the position of this second optical element 101.

It will be appreciated from the foregoing that the present invention thus makes it possible in a simple and low cost way to ensure the position of the second optical element of an optical module, this second optical element making it possible on the one hand to form the second light beam that contributes to the main beam lights and on the other hand to create the cutoff zone for the first light beam that forms the low beam lights.

The invention must not, however, be limited to the means and configurations described and illustrated here and also extends to all equivalent means or configurations and any technically feasible combination of such means. In particular, the shape and layout of the first contact zone and of the second contact zone may be modified without detracting from the invention insofar as they perform the functionalities described in this document.

The invention claimed is:

1. A monobloc optical element, comprising:

a first end including a plurality of light inlets distinct from one another via which rays of light enter the monobloc optical element;

a second end via which the rays of light exit together, the second end being configured to shape a beam of light external to the monobloc optical element;

an axis passing at least through the first end and through the second end;

at least a first contact zone dedicated to referencing the monobloc optical element mechanically along the axis;

at least a second contact zone dedicated to referencing the monobloc optical element mechanically in a direction transverse to the axis, the second contact zone being closer to the second end than to the first end; and at least one arm arranged on at least one side of the monobloc optical element, the at least one arm being configured to support the monobloc optical element, the at least one arm including the first contact zone and the second contact zone.

2. The monobloc optical element according to claim 1, wherein a first plane passing through the first contact zone and a second plane passing through the second contact zone form an angle comprised between 45° and 90°.

3. The monobloc optical element according to claim 1, further comprising a sharp edge situated at an intersection between the second end and a face of the monobloc optical element, the sharp edge being configured to cut off the external beam of light.

4. The monobloc optical element according to claim 1, wherein the first contact zone is closer to the first end of the monobloc optical element than to the second end thereof.

5. The monobloc optical element according to claim 1, wherein the first contact zone and the second contact zone are closer to the second end of the monobloc optical element than to the first end thereof.

6. The monobloc optical element according to claim 1, wherein the first contact zone and the second contact zone are formed respectively at a first longitudinal end and at a second longitudinal end of the arm of the monobloc optical element.

7. The monobloc optical element according to claim 1, wherein the first contact zone and the second contact zone are both formed at the one same longitudinal end of the arm, the longitudinal end being closest to the second end.

8. The monobloc optical element according to claim 1, further comprising two arms arranged respectively on a first lateral face and on a second lateral face of the monobloc optical element, the first lateral face and the second lateral face being opposite with respect to a body of the monobloc optical element and each including a first contact zone and a second contact zone.

9. An optical module comprising:

at least a first light source dedicated to forming a first light beam referred to as "low beam";

at least a second light source dedicated to forming a second light beam referred to as "high beam", the first light source and the second light source being supported by a base;

at least a first optical element dedicated to forming the first light beam;

a monobloc optical element dedicated to forming the second light beam, including a first end including a plurality of light inlets distinct from one another via which rays of light enter the monobloc optical element;

a second end via which the rays of light exit together, the second end being configured to shape a beam of light external to the monobloc optical element;

an axis passing at least through the first end and through the second end, at least a first contact zone dedicated to referencing the monobloc optical element mechanically along the axis;

at least a second contact zone dedicated to referencing the monobloc optical element mechanically in a direction transverse to the axis, the second contact zone being closer to the second end than to the first end; and at least one arm arranged on at least one side of the monobloc optical element, the at least one arm being configured to support the monobloc optical element, the at least one arm including the first contact zone and the second contact zone; and a projection lens for projecting the first light beam and the second light beam, the projection lens and the base being secured to a support.

10. The optical module according to claim 9, wherein the base includes at least one heat sink dedicated to cooling the light sources.

11. The optical module according to claim 10, wherein the light sources are secured directly to the heat sink.

12. The optical module according to claim 10, wherein a portion of the heat sink forms an end stop against which the first contact zone of the monobloc optical element comes to bear.

13. The optical module according to claim 12, wherein that portion of the heat sink that forms an end stop for the first contact zone of the monobloc optical element includes a cutout configured to accept a peg emerging from the first contact zone.

14. The optical module according to claim 10, wherein the support on which the base and the projection lens are secured includes a first wall chiefly contained inside a third plane and to which the heat sink is at least secured, and a second wall chiefly contained within a fourth plane substantially perpendicular to the third plane, the second wall including at least an inclined portion, the inclined portion having a tooth against which the second contact zone of the monobloc optical element bears.

15. The optical module according to claim 14, wherein at least one stud emerges from the second wall of the support and extends in a direction parallel to the first wall of a support, the at least one arm of the monobloc optical element being configured to rest on one end of the stud.

16. The optical module according to claim 9, wherein the support has a bottom and a cover, the cover including at least one member bearing against the monobloc optical element.

17. The optical module according to claim 16, wherein the monobloc optical element includes a sharp edge situated at an intersection between the second end and a base of the monobloc optical element which faces towards the cover of the support, the sharp edge being configured to intersect the first light beam.

18. The monobloc optical element according to claim 2, further comprising a sharp edge situated at an intersection between the second end and a face of the monobloc optical element, the sharp edge being configured to cut off the external beam of light.

19. The monobloc optical element according to claim 2, wherein the first contact zone is closer to the first end of the monobloc optical element than to the second end thereof.

* * * * *